US006900402B2

(12) United States Patent
Lam et al.

(10) Patent No.: US 6,900,402 B2
(45) Date of Patent: May 31, 2005

(54) PUSHBUTTON SWITCH WITH LED INDICATOR

(75) Inventors: Yuk Nam Lam, Kowloon (HK); King Mo Shum, Kowloon (HK)

(73) Assignee: Jeckson Electric Co., Ltd., Kowloon (HK)

( * ) Notice: Subject to any disclaimer, the term of this patent is extended or adjusted under 35 U.S.C. 154(b) by 0 days.

(21) Appl. No.: 10/707,717

(22) Filed: Jan. 6, 2004

(65) Prior Publication Data

US 2004/0129544 A1 Jul. 8, 2004

Related U.S. Application Data

(60) Provisional application No. 60/438,672, filed on Jan. 8, 2003.

(51) Int. Cl.[7] ..... H01H 9/20; H01H 3/12

(52) U.S. Cl. ..... 200/314; 200/406; 200/341

(58) Field of Search ..... 200/5 A, 406, 200/512, 517, 302.1, 302.2, 310, 313, 314, 341, 345

(56) References Cited

U.S. PATENT DOCUMENTS 3,996,441 A * 12/1976 Ohashi ..... 200/309
4,131,777 A * 12/1978 Bailey et al. ..... 200/311
4,365,120 A * 12/1982 Pounds ..... 200/5 A
5,510,782 A * 4/1996 Norris et al. ..... 341/22
5,697,493 A * 12/1997 Sach et al. ..... 200/314
6,040,534 A 3/2000 Beukema
6,552,289 B2 * 4/2003 Kawaguchi et al. ..... 200/512
6,621,025 B2 9/2003 Yei

FOREIGN PATENT DOCUMENTS

CN 2433724 6/2001

* cited by examiner

*Primary Examiner*—Michael A. Friedhofer
(74) *Attorney, Agent, or Firm*—Darby & Darby

(57) ABSTRACT

The present invention provides a mini switch assembly at low costs and being able to display on or off state of it. The switch assembly in accordance with the present invention includes a pushbutton that has an opening allowing a transparent cover installed in it; a circuit board having a circuit and defining a first conductive section being insulated with a second conductive section; a conductive elastic part coupled to but its body section separated from the first conductive section. When the pushbutton applies a force to the elastic part, the body section is forced to contact the second conductive section and as a result, the first conductive section is conductively coupled with the second conductive section, triggering a drive circuit on the circuit board to provide power to turn the LED on. Also, the elastic part has an opening aligned with the pushbutton opening to allow the LED to be installed on the circuit board via these two openings.

10 Claims, 6 Drawing Sheets

PUSHBUTTON SWITCH WITH LED INDICATOR

CROSS REFERENCE TO RELATED APPLICATIONS

The present invention claims the benefit under 35 U.S.C. 119(e) of provisional application No. 60/438,672, filed on Jan. 8, 2003. This provisional application and other documents referred to elsewhere in the specification of the present application are incorporated herein by reference.

TECHNICAL FIELD

The present invention generally relates to switches and, more particularly, to a pushbutton switch incorporated with a LED indicator.

BACKGROUND

To transmit trigger signals, contact switches become popular in application as discrete devices for coupling to electrical signals. Contact switches are classified as rocker switches and pushbutton switches. Commonly, a pushbutton switch has an elastic part and a connector coupled to a circuit. On the basis of the states (on or off) of the elastic part with respect to the connector, the switch function is implemented.

On the other hand, in order for a user to assure if a contact switch is on, an indicator is installed in the switch, showing the on or off state of the switch. However, the current contact switches take large space with complicated structures at high costs since in each of these switches, the indicator and the switch are discretely installed.

U.S. Pat. No. 6,621,025 to Yei et al., ("Yei" hereinafter) entitled "Rocker Switch with LED Indicators" proposed a switch assembly that comprise a base having two pairs of L-shaped members received therein and each of the L-shaped members has a spring connected thereon. Two V-shaped members are respectively located between the two pairs of L-shaped members. A frame is mounted on the base and has an open top. A flange extends from an inside of the open top and has four apertures defined there through. A circuit board is supported on the flange in the frame and two LEDs are connected on the circuit board.

Four bosses extend from an underside of the circuit board and contact the spring via the apertures in the flange. A cap is engaged with the open top of the frame and two holes are defined through the cap so that the LEDs are engaged with the holes. An activation member extends through the circuit board and a shaft of the activation member extends through the cap. Two extensions of the activation member contact the V-shaped members. A see-saw switch is connected to the shaft of the activation member.

While the switch proposed by Yei combines LEDs with a switch to render an assembly taking small space and a lot fewer parts, its structure is still quite complicated and manufacture costs are high. In addition, the Yei's switch works by tilting the see-saw switch at right end or left end, so this structure is only applied to rocker switches, not to pushbutton switches.

Current pushbutton used for electrical products functions as a switch. When an on or off state is to be displayed, an extra circuit for controlling a LED is required. Furthermore, a receipt hole has to be made on the panel of the electrical product to accommodate the LED indicator, taking much space.

U.S. Pat. No. 6,040,534 to Beukema ("Beukema" hereinafter) discloses an integrally molded switch lighting and electronics, including a cover 70 with translucent indicia 84 directly above phosphorous electro luminescent pad 67, as shown in FIG. 1. Beukema's arrangement uses the resilience of the polycarbonate cover 70 to bias the return of the switch in a cantilever-like arrangement. While Beukema integrates the display part and the switch, it does not save space. Also, since this switch is used on a flexible circuit, it makes the manufacture complicated.

Chinese Utility Model Patent No. CN 2433724Y ("CN Patent" hereinafter) taught an improved pushbutton switch including a upper shell, a pushbutton pole, a spring, and a lower shell. On the upper shell are arranged an accommodation room, two hole, a "□" control pole and a plurality of tenon slots. The pushbutton pole is of a control track and a groove for the use of two connectors. On the lower shell are a LED, a base trough for setting up the LED, a tenon slot for coupling to the upper shell. By pressing the switch, the circuit is connected and through the LED imbedded in the pushbutton switch, the on or off state is displayed. This patent also exists the problems of needs of many parts and bulk structure. It is hard to be used in portable electrical products and lacks aesthetic feelings.

Accordingly, what is needed is a switch assembly of mini size, simple structure, high integration, aesthetic appearance, and low costs. Moreover, the switch assembly may display it on or off state of it.

DESCRIPTION

An objective of the present invention is to provide a mini switch assembly at low costs and being able to display on or off state of it.

A switch assembly in accordance with the present invention includes a pushbutton that has a first opening running through it; a transparent cover installed in the first opening; a circuit board having a circuit and defining a first conductive section being insulated with a second conductive section; a conductive elastic part having at least one contact coupled to the first conductive section and a body section separated from the first conductive section. The second conductive section is contacted by the pushbutton so that when the pushbutton applies a force to the conductive elastic part, the body section is forced to contact the second conductive section and as a result, the first conductive section is conductively coupled with the second conductive section to provide an on state. Alternatively, when the pushbutton does not apply a force to the conductive elastic part, the body section keeps its distance from the second conductive section and as a result, the first conductive section is insulated with the second conductive section to provide an off state. Furthermore, a LED indicator is installed between the transparent cover and the circuit board and conductively coupled to the circuit. By the trigger of the on state, the LED turns on.

In accordance with one embodiment of the present invention, the circuit board is a PCB. Furthermore, the circuit board has at least one aperture for receipt of the contact of the conductive elastic part. Also, the conductive elastic part may have two contacts coupled to the first conductive section.

In accordance with one aspect of the present invention, the conductive elastic part has a second opening that is aligned with the first opening. The LED is installed on the circuit board via the second opening.

Optionally, the first opening is at enter of the pushbutton and of a shape of square, diamond, round, ellipse, or trapeziform.

In accordance with the other embodiment, the switch assembly is used in a charger so as to provide a mini electrical product of aesthetic appearance at low costs with indication of its on or off state.

These and other features, objectives and advantages of the present invention will become apparent upon reading the following description thereof together with reference to the accompanying drawings.

BRIEF ILLUSTRATION OF DRAWINGS

PREFERRED EMBODIMENTS

Figure 1:
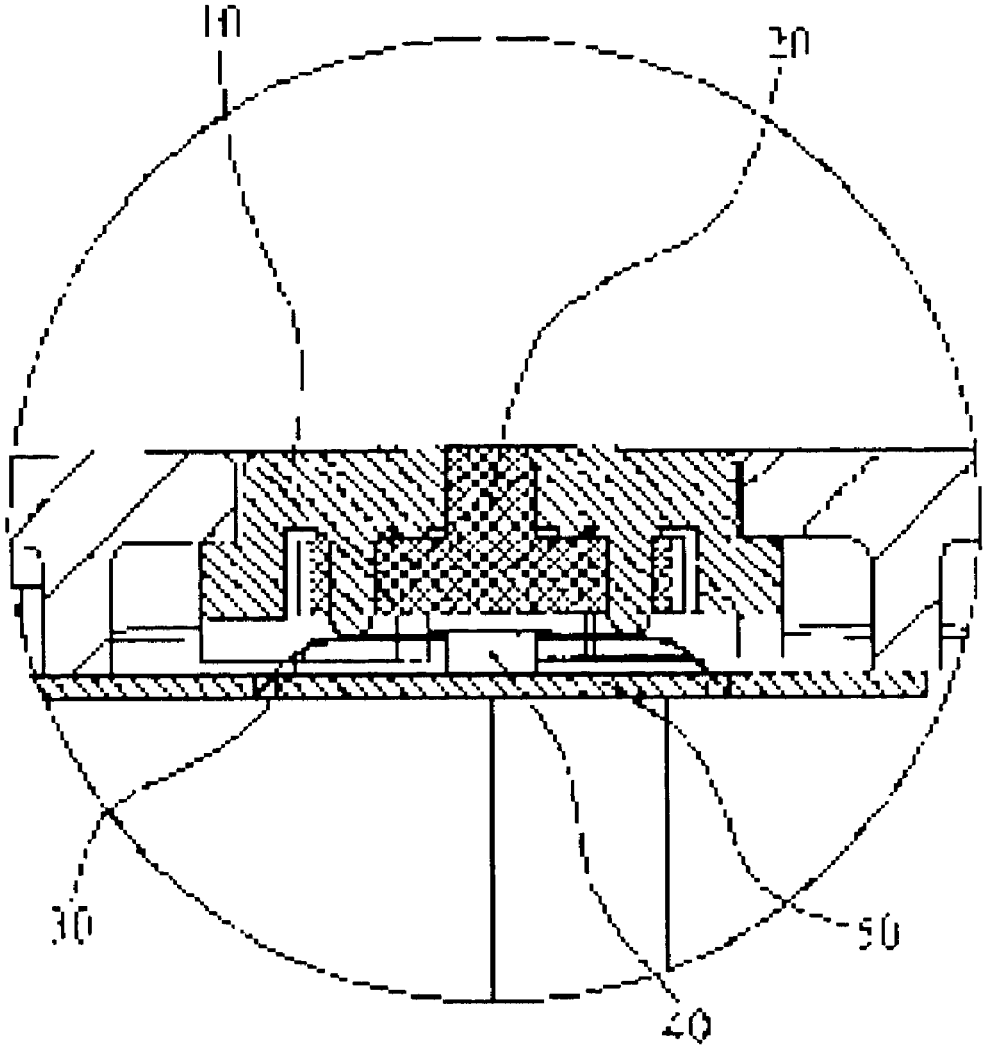
FIG. 1 shows a structure of the pushbutton switch assembly in accordance with the present invention.
Figure 2:
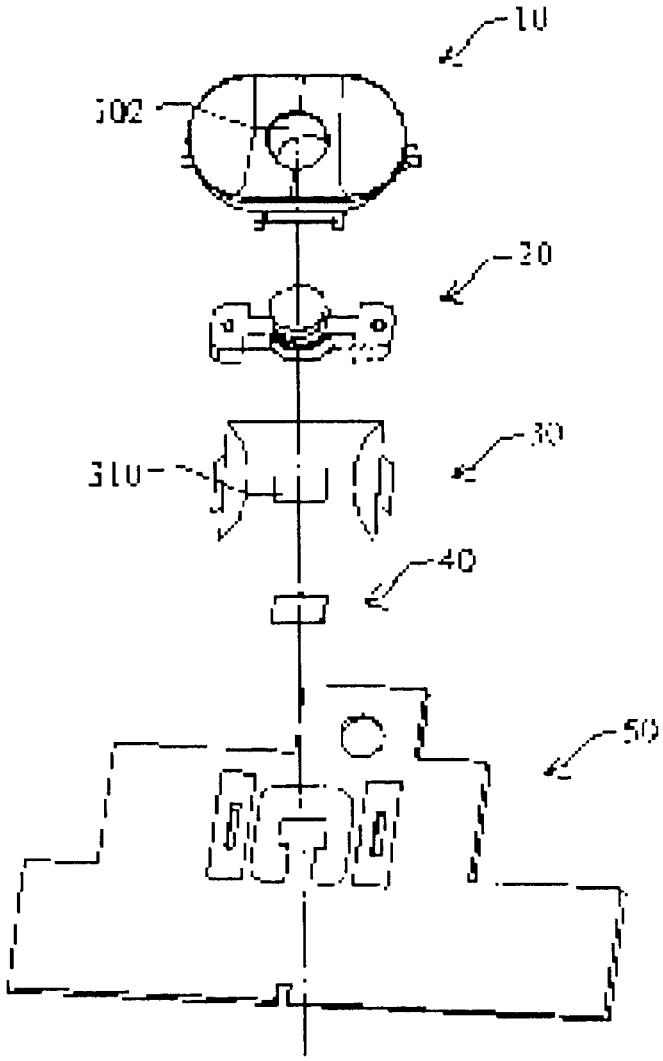
FIG. 2 is an exploded view showing the pushbutton switch assembly in accordance with the present invention.

Referring to FIG. 1, it shows a structure of the pushbutton switch assembly in accordance with the present invention and its exploded view in FIG. 2 shows the interconnection among those parts of the pushbutton switch assembly. The pushbutton switch assembly has a pushbutton 10, a transparent cover 20, a conductive elastic part 30, a LED 40, and a circuit board 50. The transparent cover 20 is in the opening 102 of the pushbutton 10. The pushbutton 10 contacts with elastic part 30, LED 40 is fixed on circuit board 50, and elastic part 30 couples to circuit board 50.

Figure 3:
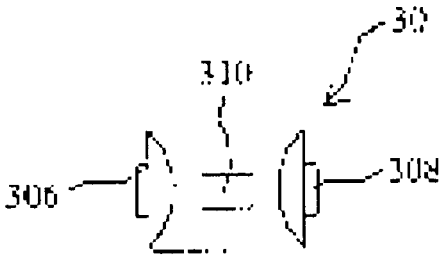
FIG. 3 is a plan view of the elastic part of the pushbutton switch assembly in accordance with the present invention.
Figure 4:
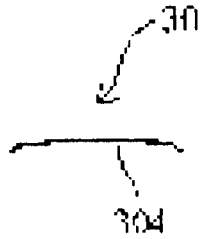
FIG. 4 is front view of the elastic part of the pushbutton switch assembly in accordance with the present invention.
Figure 5:
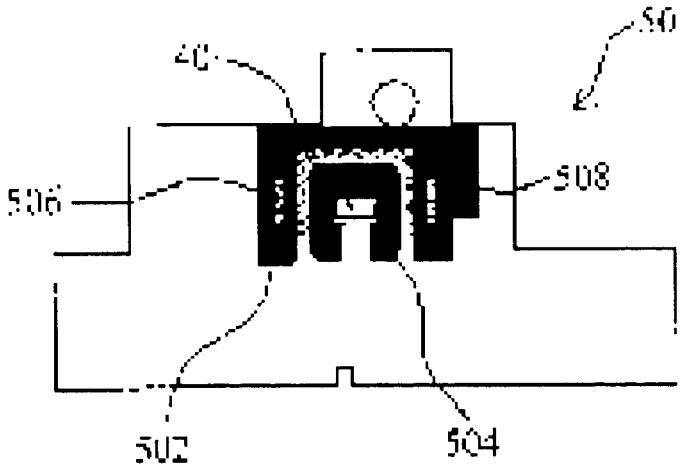
FIG. 5 is a plan view of the circuit board of the pushbutton switch assembly in accordance with the present invention, which shows the LED installed on it.

As shown in FIGS. 3 and 4, elastic part 30 shapes arc with two pins 306 and 308 at both sides. Its body section is 304. Correspondingly, receipt holes 506 and 508 are arranged respectively on a first conductive section 502, and a second conductive section 504 is defined on circuit board 50. In particular, both of them are insulated with each other, as shown in FIG. 5. By insertion of two pins 306 and 308 of elastic part 30 into receipt holes 506 and 508 on the first conductive section 502, elastic part 30 is coupled to circuit board 50. As a result, elastic part 30 conductively contacts with first conductive section 502, while its body section 304 separates from second conductive section 504 of circuit board 50 for a distance. It indicates an off state of the switch assembly. Also, FIG. 5 illustrates LED 40 is fixed on circuit board 50 with its lead coupling to a drive circuit on the circuit board 50, which provides power to LED 40, turning it on when elastic part 30 is at an on state.

In the other embodiment in accordance with the present invention, elastic part 30 may have only one pin 306 instead of two. In this case, pin 306 is inserted into receipt hole 506 to couple elastic part 30 to circuit board 50 so that elastic part 30 becomes conductively coupled to the first conductive section 502 while its body section 304 is not in contact with the second conductive section 504 of the circuit board 50, keeping pushbutton switch at an "off" state. Optionally, other available means in current market or its equivalents may be used to couple elastic part 30 to circuit board 50.

The circuit board 50 in accordance with the present invention is PCB in which elastic part 30 is an integrated one, as shown in FIGS. 3 and 4. On elastic part 30 opening 310 is arranged. Through opening 310 LED 40 aligns with transparent cover 20. Alternatively, elastic part 30 may have a "U" shape. In this case, LED 40 installed on circuit board 50 runs through the "U" opening of elastic part 30 and aligns with transparent cover 20.

Figure 6:
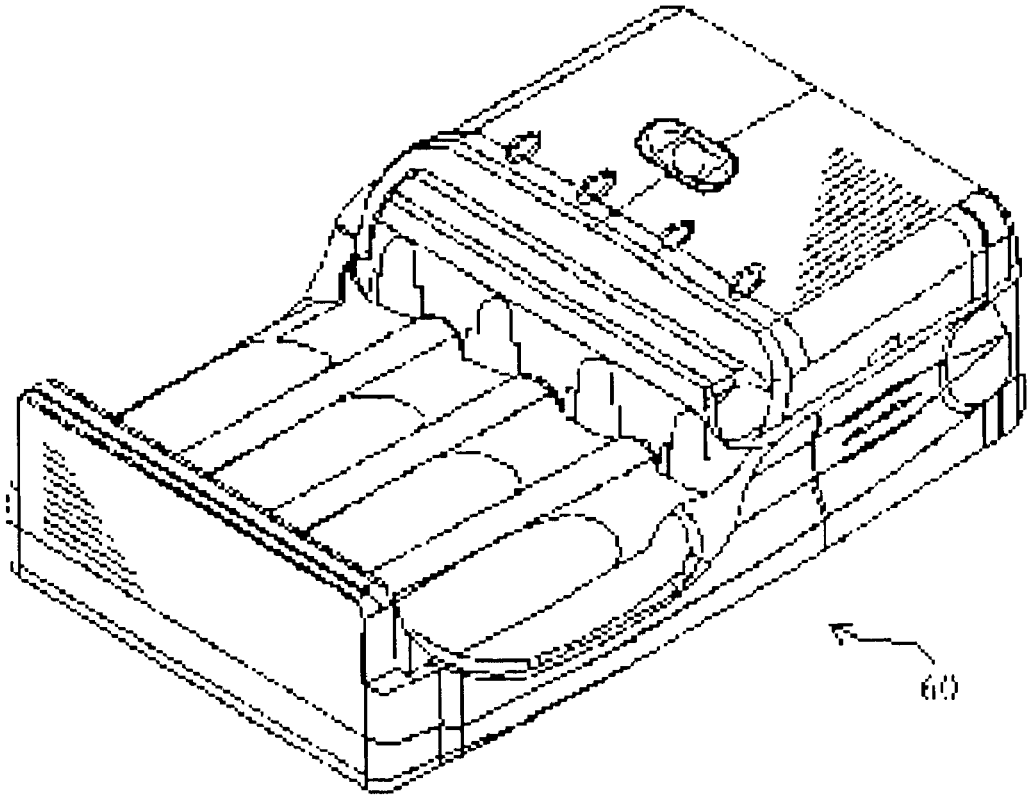
FIG. 6 shows a charger in accordance with the present invention.

As an application of the switch assembly in accordance with the present invention, a charger 60 is provided as shown in FIG. 6. The assembly operation of the charger is shown as below.

Figure 7:
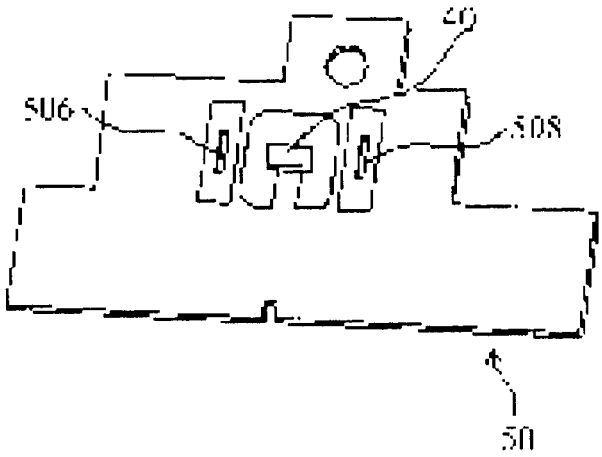
FIGS. 7–11 illustrates the switch assembly installed on the charger of FIG. 5.
Figure 8:
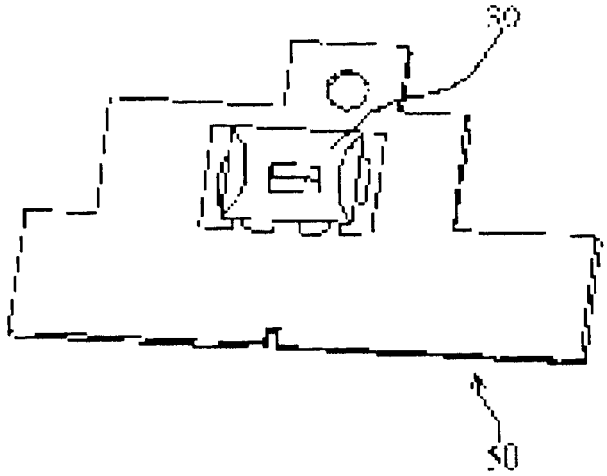

Referring to FIGS. 7 and 8, LED 40 is fixedly coupled to circuit board 50. By the insertion of pins 306 and 308 of elastic part 30 into receipt holes 506 and 508 on circuit board 50, elastic part 30 is installed on circuit board 50. In this case, elastic part 30 is conductively coupled to the first conductive section 502 while its body section 304 is not in contact with the second conductive section 504 of the circuit board 50, so pushbutton switch is at an "off" state.

Figure 9:
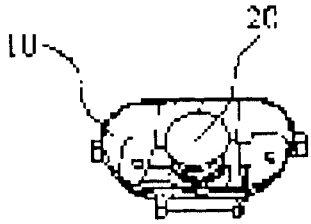
Figure 10:
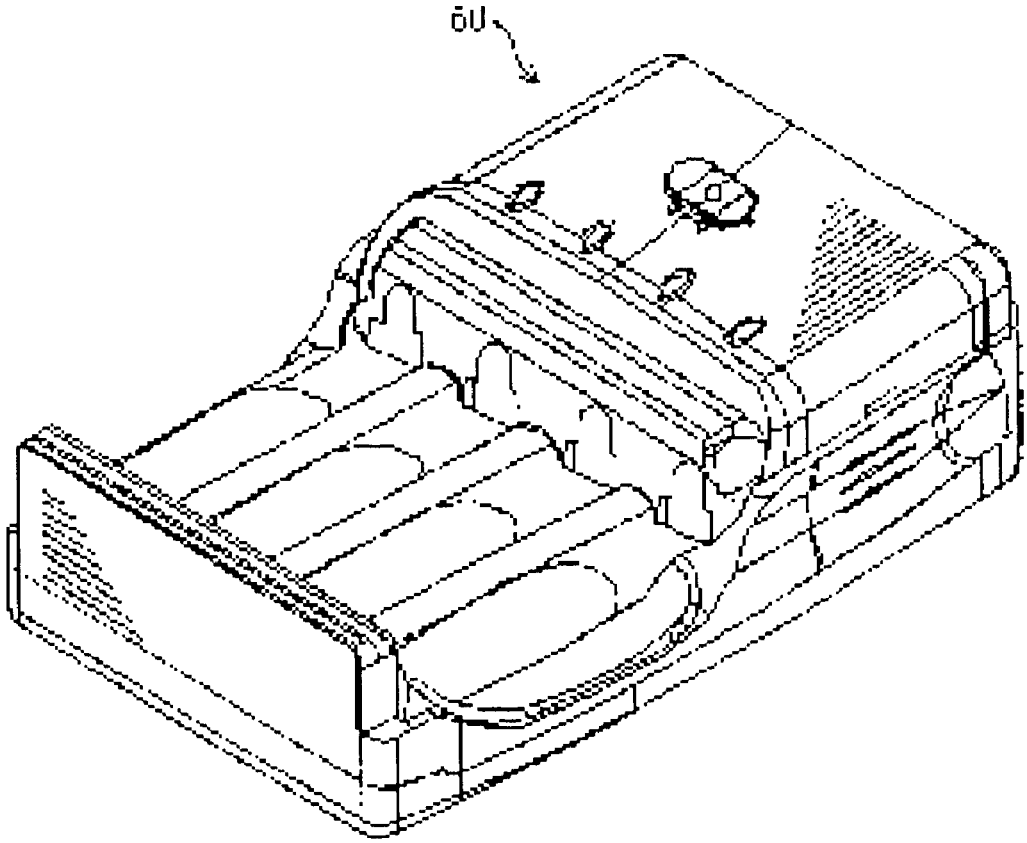
Figure 11:
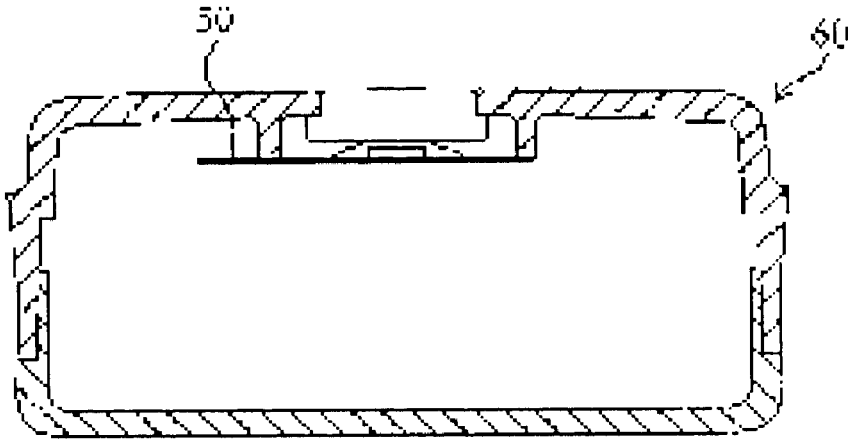

As shown in FIG. 9, transparent cover 20 is installed on pushbutton 10 by insertion of it into opening 102 of pushbutton 10. Furthermore, pushbutton 10 and transparent cover 20 are installed in housing of charger 60, as shown in FIG. 10. Finally, as shown in FIG. 11, circuit board 50 is installed in the housing to provide charger 60 in accordance with the present invention.

Through the interconnection of each part of the switch assembly in accordance with the present invention, shown in FIGS. 1 and 2, LED indicator 40 is under the opening at the enter of elastic part 30, so that the light emitted from LED indicator 40 via the opening does not intervene with elastic part 30 when which moves downward by force. In the case that a force is applied to the pushbutton 10 of the switch assembly, the light emitted from LED indicator 40 via the opening does not intervene with elastic part 30 since the distance between pushbutton 10 and elastic part 30. As a result, the light from LED indicator 40 emits via transparent cover 20.

Optionally, opening 102 of pushbutton 10 in accordance with the present invention may be a shape of square, diamond, round, ellipse, or trapeziform. Correspondingly, transparent cover 20 may be designed to present aesthetic feelings as demanded.

Figure 12:
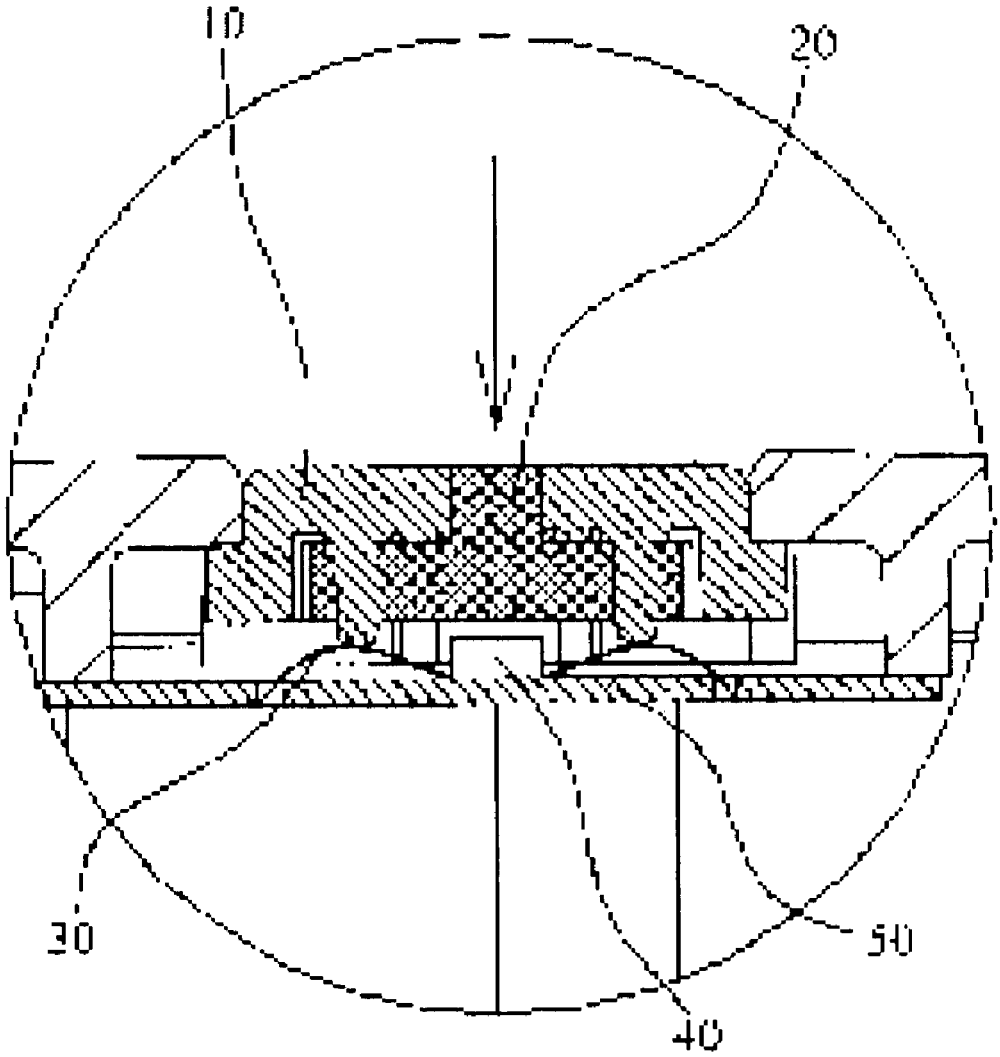
FIG. 12 is a cross sectional view showing the position the elastic part is pressed down.

The operation principle of the switch assembly in accordance with the present invention is described in cooperation with FIG. 12. When a user pushes pushbutton 10 down, the force is transferred to elastic part 30, which results in a flexible distortion of elastic part 30. As a result, body section 304 of elastic part 30 becomes in contact with second conductive section 504 of the circuit board 50, conductively coupling first conductive section 502 to second conductive section 504. Thus, the drive circuit of circuit board 50 drives LED indicator 40 on and the light emitted from LED indicator 40 goes through transparent cover 20, showing the "on" state of switch assembly.

It is understood that the switch assembly in accordance with the present invention is not only used in chargers, but also in all kinds of electrical products, in particular, in mini electrical products being able to indicate "on" or "off" state and requiring a switch assembly to take small space.

In accordance with the other embodiment, the switch assembly may have transparent cover 20, instead pushbutton 10, to function as a pushbutton.

While there have been illustrated and described what are considered to the preferred embodiments of the present invention, it will be understood by those skilled in the art that various changes and modifications may be made, and equivalents may be substituted for parts thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A switch assembly comprising:

a pushbutton having a first opening;

a transparent cover installed in the first opening;

a circuit board having a circuit, said circuit board defining a first conductive section and a second conductive section, and said first conductive section being insulated with the second conductive section;

a conductive elastic part having at least one contact being coupled to said first conductive section, a body section being separated from said first conductive section and said second conductive section and contacted by said pushbutton, wherein said circuit board has at least one aperture for receipt of said one contact of said conductive elastic part;

when said pushbutton applies a force to the conductive elastic part, said body section is forced to contact said second conductive section so that said first conductive section is conductively coupled with said second conductive section to provide an on state;

when said pushbutton does not apply a force to the conductive elastic part, said body section separates from said second conductive section so that said first conductive section is insulated with said second conductive section to provide an off state; and a LED installed between said transparent cover and said circuit board, said LED being conductively coupled to the circuit of said circuit board so that by the trigger of the on state, the LED becomes light.

2. The switch assembly as recited in claim 1 wherein said circuit board is a PCB.

3. The switch assembly as recited in claim 1 wherein said conductive elastic part has two contacts coupled to said first conductive section.

4. The switch assembly as recited in claim 1 wherein said conductive elastic part has a second opening, said LED being installed on the circuit board via said second opening.

5. The switch assembly as recited in claim 4 wherein said first opening is at the center of the pushbutton and of has a shape of a square, diamond, round, ellipse, or trapeziform.

6. A charger including a switch assembly, said switch assembly comprising:

a pushbutton having a first opening;

a transparent cover installed in the first opening;

a circuit board having a circuit, said circuit board defining a first conductive section and a second conductive section, and said first conductive section being insulated with the second conductive section;

a conductive elastic part having at least one contact being coupled to said first conductive section, a body section being separated from said first conductive section and said second conductive section and contacted by said pushbutton, a second opening being aligned with said first opening, wherein said circuit board has at least one aperture for receipt of said one contact of said conductive elastic part;

when said pushbutton applies a force to the conductive elastic part, said body section is forced to contact said second conductive section so that said first conductive section is conductively coupled with said second conductive section to provide an on state;

when said pushbutton does not apply a force to the conductive elastic part, said body section separates from said second conductive section so that said first conductive section is insulated with said second conductive section to provide an off state; and a LED installed between said transparent cover and said circuit board, said LED being conductively coupled to the circuit through said first and second openings so that by the trigger of the on state, the LED becomes light.

7. The switch assembly as recited in claim 6 wherein said circuit board is a PCB.

8. The switch assembly as recited in claim 6 wherein said conductive elastic part has two contacts coupled to said first conductive section.

9. The switch assembly as recited in claim 6 wherein said LED is installed on the circuit board via said second opening in said conductive elastic part.

10. The switch assembly as recited in claim 9 wherein said first opening is at the center of the pushbutton and has a shape of a square, diamond, round, ellipse, or trapeziform.

* * * * *